United States Patent [19]

Ratowsky

[11] 3,977,876

[45] Aug. 31, 1976

[54] METHOD OF PROCESSING PHOTOGRAPHIC MATERIAL

[75] Inventor: Simon Ratowsky, Downsview, Canada

[73] Assignee: Monrick Holdings Limited, Downsview, Canada

[22] Filed: Jan. 7, 1975

[21] Appl. No.: 539,255

Related U.S. Application Data

[62] Division of Ser. No. 427,798, Dec. 26, 1973, Pat. No. 3,905,584.

[52] U.S. Cl. ..... 96/48 R; 259/72; 354/328; 96/200

[51] Int. Cl.[2] ..... G03C 5/24; B01F 9/02; B01F 11/00

[58] Field of Search ..... 96/48 R, 200; 259/72; 354/297, 312, 323, 327, 328, 329, 330, 81 R, 91

[56] References Cited

UNITED STATES PATENTS

| | | | |
|---|---|---|---|
| 2,947,236 | 8/1960 | Siegel | 354/330 |
| 3,668,997 | 6/1972 | Ratowsky | 134/137 |
| 3,705,544 | 12/1972 | Ratowsky | 96/48 R |

*Primary Examiner*—Won H. Louie, Jr.

[57] ABSTRACT

A method and apparatus for the processing of photographic material in which the material is mounted arcuately in a tubular carrier which is horizontally disposed, charged in its lower portion with processing liquid, and rotated about its longitudinal axis while at the same time being oscillated in the direction of that axis. In the apparatus the carrier rests on a base with means on the carrier and on the base interengagable to oscillate the carrier when it is rotated.

1 Claim, 5 Drawing Figures

METHOD OF PROCESSING PHOTOGRAPHIC MATERIAL

This is a division of application Ser. No. 427,798 filed Dec. 26, 1973 now U.S. Pat. No. 3,905,584.

This invention relates to the processing of photographic material in sheet or roll form.

To reduce the quantity of liquid chemicals used in processing photographic material, rotatable containers or carriers are employed instead of dishes or tanks. Such carriers are tubular and carry the photographic material arcuately within them. A small quantity of liquid chemical is introduced into the carrier which is disposed horizontally and rotated about its longitudinal axis, allowing the liquid to contact all parts of the photographic material, as seen in U.S. Pat. No. 2,947,236 issued Aug. 2, 1960 to H. Siegel. To obtain increased flow the drum may be rocked vertically as shown for example in U.S. Pat. No. 3,668,997 issued June 13, 1972 to S. Ratowsky assignor to Monrick Holdings Limited.

New types of photographic paper recently introduced to the market, such as resin coated or plastic papers, eliminate stop baths and require increased but relatively even flow or agitation of liquid chemical within the carrier to prevent stains but the amount of agitation must be selective.

It is an object of the present invention to provide an improved method and device for processing photographic material in a carrier by oscillating a horizontally disposed tubular carrier in the direction of its longitudinal axis as the carrier rotates about that axis.

Example embodiments of the invention are shown in the accompanying drawings in which.

Figure 1:
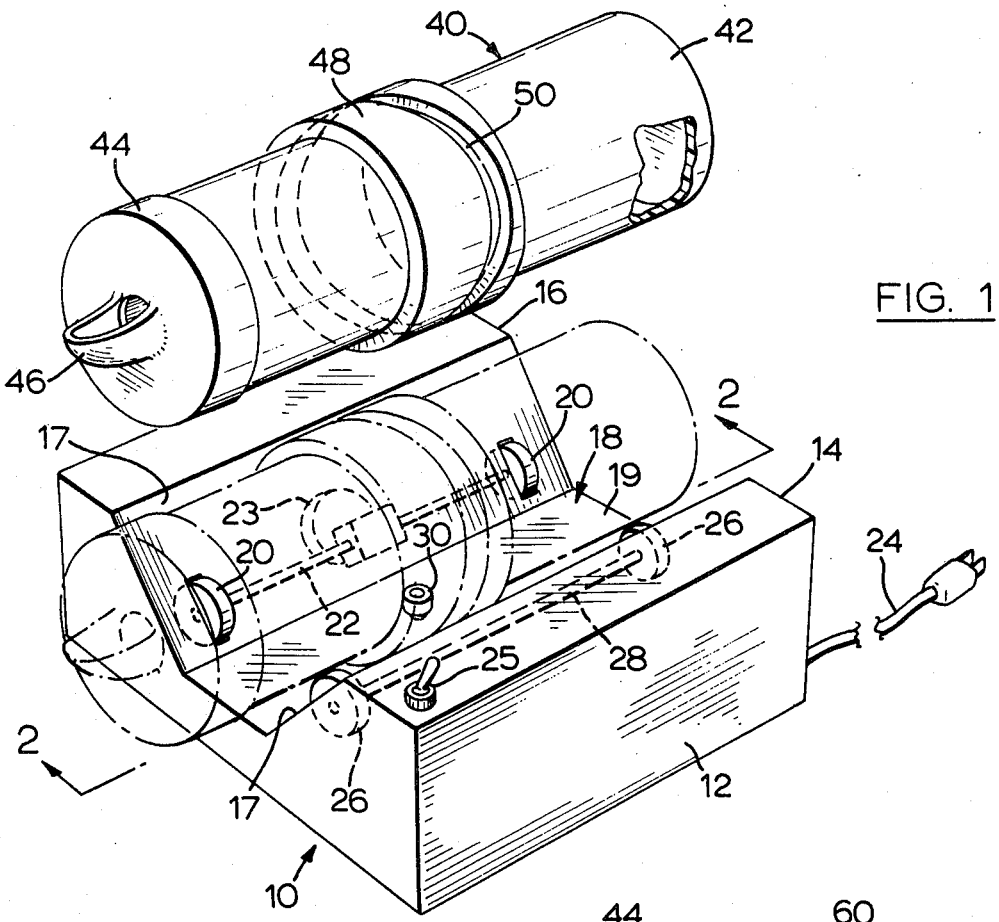
FIG. 1 is a perspective view of a base and a carrier.
Figure 2:
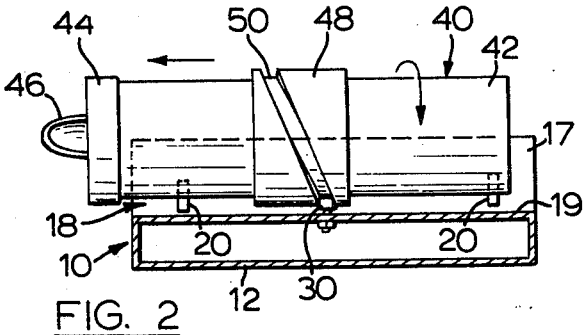
FIG. 2 is a cross-sectional view of the base of the device of FIG. 1 and a side view of the carrier in one extreme position of horizontal travels on the base.
Figure 3:
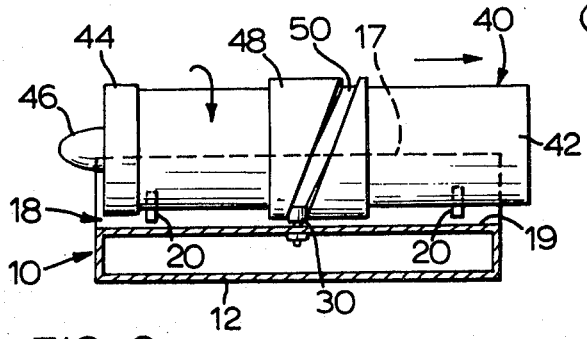
FIG. 3 is a view similar to FIG. 2 showing the carrier in the other extreme position of horizontal travel.

The embodiment shown in FIGS. 1 to 3 of the drawings comprises a base 10 having a rectangular housing 12 including a pair of upstanding parallel shoulders 14 and 16 which are spaced apart with outwardly sloping opposed sides 17 to form a trough 18 having a flat bottom 19. A spaced pair of drive wheels 20 are keyed on a drive shaft 22 which is located within shoulder 16 and is driven by an electric motor 23 also located in shoulder 14. Motor 23 is connectable by a line 24 to a source of electric current and is actuated by a switch 25. A segment of each drive wheel 20 projects normally from side 17 of shoulder 14 into trough 18. A spaced pair of idler wheels 26 are keyed on an idler shaft 28 which is journally mounted within shoulder 16. A segment of each idler wheel 26 also projects normally from side 17 of shoulder 16 into trough 18. A follower or guide roller 30 is journally mounted on bottom 19 of trough 18.

A carrier 40 receivable in trough 18 and comprises a cylindrical drum 42 with a removable end cap 44 which closes the drum to receive liquid processing chemicals through a spout 46 when photographic sheet material has been placed arcuately in the drum. A raised band 48 girdles the central portion of drum 42 and carries a track or groove 50 circumscribing the drum in a plane which is oblique to the drum axis. Band 48 is positioned on drum 42 to have guide roller 30 located in groove 50 when the drum rests on wheels 20 and 26. Roller 30 and groove 50 comprise interengaging means between carrier 40 and base 10.

In the operation of the device carrier 40 is loaded by placing photographic sheet material arcuately within drum 42, placing end cap 44 on the drum, and charging the drum with liquid photographic chemical through spout 46. Carrier 40 is then placed horizontally in trough 18 of base 10 to ride on wheels 20 and 26 with guide roller 30 positioned in groove 50 of band 48. When carrier 40 is in this position, motor 23 is started by switch 25 when line 24 is plugged into a source of electrical energy. Motor 23 rotates shaft 22 which rotates drive wheels 20, turning drum 42 on its axis. As carrier 40 rotates, guide roller 30 travels along groove 50. Since band 48 is fixed on drum 42 and guide roller 30 is fixed in bottom 19 of housing 12, the rotation of carrier 40 causes it to move horizontally first in one direction and then in the opposite direction as seen in FIGS. 2 and 3, sliding transversely on wheels 20 and 26. This horizontal sinusoidal oscillation causes the liquid chemical in carrier 40 to move longitudinally along drum 42 and over the sheet of photographic material within the carrier. The speed of rotation of carrier 40 may be made variable by suitable rheostat means to obtain an optimum longitudinal movement of the liquid chemical in the carrier.

It will be appreciated that various modifications to the example embodiment could be made within the concept of the invention. For example carriers 40 of differing diameters could be accommodated in trough 18 of base 10 by adjusting the position of idler wheels 26 and/or the height of guide rollers 30 or 62 above bottom 19 of the trough. The obliquity of groove 50 or ridge 60 could be altered to change the amplitude or length of oscillatory travel of carrier 40 along its axis, for instance by having band 48 or ridge 60 removably mounted on drum 42 for replacement. Of course groove 50 could be located in the wall of drum 42.

Figure 4:
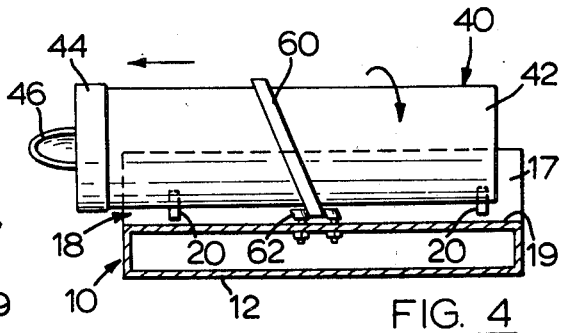
FIG. 4 is a view similar to FIG. 2 showing an alternate embodiment of the invention.

In the alternate embodiment shown in FIG. 4 a circumscribing ridge 60 on drum 42 of carrier 40 is engaged between a pair of spaced followers or guide rollers 62 journally mounted on bottom 19 of trough 18. Ridge 60 lies in a plane which is oblique to the longitudinal axis of drum 42 and the contact face of each roller 62 is sloped accordingly. The operation of this alternate embodiment is the same as that described for the embodiment of FIGS. 1 to 3.

Figure 5:
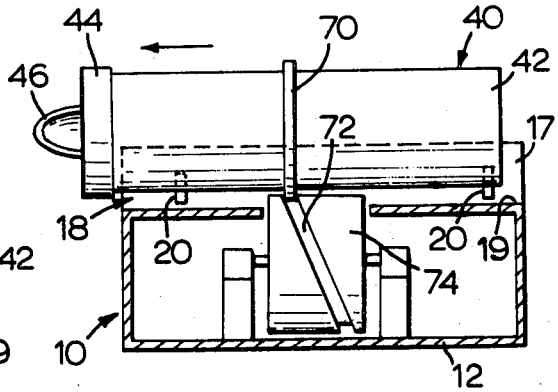
FIG. 5 is a view similar to FIG. 2 showing still another alternate embodiment of the invention.

In the further embodiment shown in FIG. 5 a circumscribing rib 70 on drum 42 lies in a plane normal to the longitudinal axis of drum 42 and is engaged in a groove 72 circumscribing a cylindrical follower or spool 74 rotatably mounted on base 10. Groove 72 lies in a plane oblique to the rotational axis of spool 74 which lies parallel to the longitudinal axis of drum 42 when carrier 40 is mounted on base 10. In this modification the frequency and amplitude of oscillation of carrier 40 would be governed by the diameter of spool 74 and the obliquity of groove 72. If desired, spool 74 could be driven to rotate carrier 40.

I claim:

1. A method of processing photographic material of the sheet or roll type, comprising the steps of:

mounting the material arcuately within a tubular carrier;

horizontally disposing the carrier with respect to the longitudinal axis of the carrier;

introducing a predetermined quantity of processing liquid into the lower portion of the horizontally disposed carrier whereby the photographic material is contacted by the liquid on rotation of the carrier and closing the carrier;

rotating the carrier about its horizontal longitudinal axis and simultaneously oscillating the carrier in the direction of said axis in the form of a sine wave thereby causing the processing liquid in the carrier to move longitudinally along said axis and over said photographic material; and after a predetermined time interval, removing the liquid from the carrier.

* * * * *